US012617567B2

(12) United States Patent
Biondi et al.

(10) Patent No.: US 12,617,567 B2
(45) Date of Patent: May 5, 2026

(54) PACKAGING UNIT FOR PACKAGING ARTICLES IN BOXES AND METHOD FOR PACKAGING ARTICLES IN BOXES

(71) Applicant: R.A JONES & CO., Covington, KY (US)

(72) Inventors: Andrea Biondi, Bologna (IT); Luca Cavazza, Bologna (IT); Ivanoe Bertuzzi, Bologna (IT); Enrico Campagnoli, Bologna (IT)

(73) Assignee: R.A JONES & CO., Covington, KY (US)

( * ) Notice: Subject to any disclaimer, the term of this patent is extended or adjusted under 35 U.S.C. 154(b) by 0 days.

(21) Appl. No.: 18/724,350

(22) PCT Filed: Dec. 20, 2022

(86) PCT No.: PCT/IB2022/062558

§ 371 (c)(1),
(2) Date: Jun. 26, 2024

(87) PCT Pub. No.: WO2023/126773

PCT Pub. Date: Jul. 6, 2023

(65) Prior Publication Data

US 2025/0058913 A1 Feb. 20, 2025

(30) Foreign Application Priority Data

Dec. 29, 2021 (IT) ..... 102021000032948
Dec. 29, 2021 (IT) ..... 102021000032984

(51) Int. Cl.
*B65B 49/08* (2006.01)
*B65B 11/00* (2006.01)
*B65B 49/14* (2006.01)

(52) U.S. Cl.
CPC ..... *B65B 11/004* (2013.01); *B65B 49/08* (2013.01); *B65B 49/14* (2013.01)

(58) Field of Classification Search
USPC ..... 53/203
See application file for complete search history.

(56) References Cited

U.S. PATENT DOCUMENTS 4,845,924 A * 7/1989 Focke ..... B65B 11/30 53/438
2006/0043189 A1 3/2006 Agrawal et al.
(Continued)

FOREIGN PATENT DOCUMENTS

FR 3104304 A1 6/2021
WO 2019/032307 A1 2/2019
WO 2020/222236 A1 11/2020

OTHER PUBLICATIONS

Cai Minjie et al. "An Ego-Vision System for Hand Grasp Analysis" IEEE Transactions On Human-Machine Systems, IEEE, Piscataway, NJ, USA, vol. 47, No. 4, Aug. 1, 2017 (Aug. 1, 2017), pp. 524-535, [retrieved on Jul. 13, 2017] DOI: 10.1109/THMS.2017.2681423 ISSN: 2168-2291, XP011656554.
(Continued)

*Primary Examiner* — Chinyere J Rushing-Tucker
(74) *Attorney, Agent, or Firm* — Steinfl + Bruno LLP

(57) ABSTRACT

A packaging unit for packaging articles in boxes, including a mandrel, a movement device, a feeding device, a folding device, and an actuation device. The mandrel is configured to accommodate at least one of said articles inside it. The movement device is configured to move said mandrel along a movement trajectory at a desired movement speed. The feeding device is configured to feed at least one blank towards said mandrel along a feeding trajectory which intersects said movement trajectory. The folding device is intended to abut said blank and is configured to cooperate with said mandrel to fold said blank around said mandrel when said blank is positioned between said mandrel and said folding device to form one of said boxes. The actuation device is configured to displace said folding device along at least one folding stroke with an accompanying speed having at least one accompanying component with the same direction as the movement speed of the mandrel and modulus lower than the movement modulus in said folding stroke.

17 Claims, 7 Drawing Sheets

(56) References Cited

U.S. PATENT DOCUMENTS

| | | | |
|---|---|---|---|
| 2012/0206337 | A1 | 8/2012 | Hildreth et al. |
| 2020/0020112 | A1 | 1/2020 | Buibas et al. |
| 2021/0216785 | A1 | 7/2021 | Debucean et al. |
| 2023/0005348 | A1 | 1/2023 | Letierce et al. |

OTHER PUBLICATIONS

International Search Report and Written Opinion with English Translation for International Patent Application PCT/IB2022/062558 filed Oct. 12, 2022 on behalf of R.A. Jones & Co.. Mail Date: Apr. 20, 2023. 18 pages.

Xiaochen Liu et al. "Grab: Fast and Accurate Sensor Processing for Cashier-Free Shopping" Arxiv.org, Cornell University Library, 201 Olin Library Cornell University Ithaca, NY 14853, Jan. 4, 2020 (Jan. 4, 2020), XP081572231.

* cited by examiner

PACKAGING UNIT FOR PACKAGING ARTICLES IN BOXES AND METHOD FOR PACKAGING ARTICLES IN BOXES

CROSS REFERENCE TO RELATED APPLICATIONS

The present application is the U.S. national stage of International Application No. PCT/IB2022/062558 filed on Dec. 20, 2022, which, in turn, claims priority to Italian Patent Application No. 102021000032984 filed on Dec. 29, 2021, and to Italian Patent Application No. 102021000032948 filed on Dec. 29, 2021.

The present invention concerns a unit and a method for packaging articles in boxes, particularly suitable for packaging articles in accordance with a process in which it is provided for forming the box around the article to be packaged, known in the art as a "wrap-around" process.

The content of the following patent applications, filed on the same date by the same Applicant, is considered incorporated herein in their entirety:

- Italian patent application No. 102021000032948 entitled "Packaging unit for packaging articles in boxes and method for packaging articles in boxes" filed on Dec. 29, 2021;
- Italian patent application No. 102021000032993 entitled "Packaging unit for packaging articles in boxes and method for packaging articles in boxes" filed on Dec. 29, 2021;
- Italian patent application No. 102021000032984 entitled "Packaging unit for packaging articles in boxes and method for packaging articles in boxes" filed on Dec. 29, 2021;
- Italian patent application No. 102021000032915 entitled "Unit and method for packaging articles in boxes" filed on Dec. 29, 2021;
- Italian patent application No. 102021000033011 entitled "Packaging unit for packaging articles in boxes and method for packaging articles in boxes" filed on Dec. 29, 2021;
- Italian patent application No. 102021000033008 entitled "Packaging unit for packaging articles in boxes and method for packaging articles in boxes" filed on Dec. 29, 2021;
- Italian patent application No. 102021000033017 entitled "Packaging unit for packaging articles in boxes and method for packaging articles in boxes" filed on Dec. 29, 2021;
- The present invention finds a preferred, although not exclusive, application in the field of packaging for packaging in boxes articles with variable geometry and which are relatively delicate, such as for example bags of cereal flakes, a field to which reference may be made below without losing generality.

In particular, in the relevant technical field, it is known to package articles into a box according to some distinct manners.

A first manner provides a first step of forming a box, which is open at least at one end thereof, the subsequent insertion of the article to be packaged into the open box and, then, the closure of the open end.

In a second manner, the box is formed by wrapping a blank around a mandrel which is made of rigid material, for example of metal, and which contains the article to be packaged. This manner provides that the blank is wrapped around the mandrel so as to form a box closed laterally but open at least at one end thereof, from which the mandrel is then extracted leaving the article inside the newly formed box. Also in this case, the open end can be conveniently closed, so that the package thus made can be sent to the final steps of packaging and shipment to the points of sale. In this manner, a folding device is provided which folds the blank around the mandrel. The folding device may comprise a plurality of folding elements each intended to form a distinct face of the box.

In this description as well as in the accompanying claims, certain terms and expressions are deemed to have, unless otherwise expressly indicated, the meaning expressed in the following definitions.

The term "article" means any product that can be packaged in boxes. The articles can have a predetermined geometric shape or they can have a variable geometry. Preferably, the articles are food and confectionery articles, in bulk or contained inside bags or other types of wrapping, such as for example cereal bags, or coffee capsules, or capsules of other infusion beverages, single chocolates (wrapped or not), candies, pouches containing solid, liquid or semi-solid food products; in addition, articles of the ceramic industry, absorbent articles for hygienic use, articles of the tobacco industry, articles of the cosmetic industry, articles of the pharmaceutical industry, articles of the "personal & home care" industry.

By "packaging" one or more articles in a box, it is meant the fact of obtaining a box containing said one or more articles. Such packaging can be obtained by inserting one or more articles into an already formed box or, preferably, it can be obtained by forming a box around the one or more articles to be contained.

By "mandrel" it is meant a container capable, on the one hand, of accommodating and supporting the article to be packaged and, on the other hand, of providing an effective abutment for folding the blank when wrapped around it.

By "blank" it is meant a shaped sheet of appropriate material and thickness which is suitable to be wrapped by folding around a mandrel to form a box. Preferably, the blank is made of cardboard. Preferably, the blank has a thickness of at least 0.2 mm, more preferably less than 4 mm. Most preferably, the blank has a thickness comprised between 0.25 mm and 1.6 mm, more preferably between 0.3 mm and 1 mm, even more preferably between 0.4 and 0.8 mm.

A "folding line" of a blank is a predefined line around which two blank panels are provided for rotating relative to each other so as to fold the blank, preferably around the mandrel. The folding line can be a virtual, albeit predefined line. The folding line is preferably defined by a line of weakness obtained on the blank, such as for example a crease, or an incision or a plurality of aligned holes.

In general terms, a first element "abuts" a second element when the first element touches the second element and is able to at least partially oppose a relative displacement of the first element against the second element.

In particular, the blank is "abutted" by a component of the packaging unit, such as for example a mandrel or a folding device, when the component, in order to fold the blank around the folding line, abuts the blank at a distance from the folding line which is less than 10 times the thickness of the blank, preferably less than 5 times the thickness of the blank. In some versions, the abutment provides for the contact between the blank and the component of the packaging unit.

In view of the thickness of the blanks that are used in the sector of packaging articles in boxes, a folding line may be considered to be "abutted" by a component of the packaging unit when the component, in order to fold the blank around the folding line, abuts the blank at a distance from the folding line which is less than 5 mm, preferably less than 3 mm.

It should be noted that the abutment of the blank does not imply in itself that the blank is abutted for its entire surface by a component of the packaging unit, such as for example the mandrel or the folding device, but it is sufficient for it to be abutted to an extent such as to allow the correct folding necessary for the formation of the box.

In view of the thickness of the blanks used in the packaging of articles in boxes, it can be considered that two or more components of a packaging unit are in a "folding configuration" when, by acting on one side and on the other of a folding line to fold a blank, they are at a minimum distance between them of less than 10 mm, preferably less than 5 mm.

By "box" it is meant any container suitable for containing a plurality of articles for the purpose of their packaging, which can be made starting from a blank by folding around a mandrel and subsequent fixing at edges or panels thereof. Preferably, the box has at least one closed contour section, more preferably it is closed laterally around the mandrel while the longitudinal ends are kept open.

The term "trajectory" refers to the linear path travelled by an object, for example a mandrel or a blank, during its displacement. The trajectory is represented by an oriented line. A "stroke" or a "portion" of a trajectory are also represented by oriented lines.

When a trajectory, or a stroke thereof, is comprised within a plane, that plane is defined as the "advancement plane" of the object.

With reference to a particular trajectory, a first element has an "advanced position" or is positioned "downstream" with respect to a second element when along the oriented line identified by such trajectory, the first element is in a position that is subsequent to the position of the first element. In a completely similar way, a "backward position" and a position "upstream" of a first element with respect to a second element are also defined.

It is understood in the present document that two objects, for example a mandrel and a folding device, are in whole or in part "overlapped" with respect to a trajectory, when their respective orthogonal projections are in whole or in part overlapped on a plane containing the trajectory.

A vector quantity, for example the speed, is defined by a "modulus" and by a "direction", herein intended to include also the sense of direction, and can be represented by an oriented segment of length equal to the "modulus" and oriented in the sense of direction indicated by the "direction".

The Applicant has preliminarily observed that the wrap-around type packaging process briefly illustrated above allows to obtain significant advantages in terms of flexibility compared to the packaging process with insertion of the article in the preformed box. In fact, in the wrap-around type packaging process, the times required to switch from one format to another or to bring new formats into production are significantly reduced.

However, the Applicant has observed that in this packaging process when the mandrel is brought to high speeds, for example to increase the production capacity of the apparatus, the blanks may be torn or ripped during wrapping around the mandrel, in particular when the blanks have limited thickness and impact resistance.

In particular, the Applicant has observed that one of the critical steps in the process of packaging the articles in boxes, during which the blanks may be subjected to tears, is constituted by the first folding of the blank on the mandrel by means of the folding device, i.e. the passage of the blank from the planar feeding configuration to a folded configuration in which the blank is folded on the mandrel.

For this purpose, the Applicant has observed that the blank is fed via a suitable feeding device to the packaging unit in a planar configuration. The blank is interposed between the mandrel and the folding device and the step of folding the blank around the mandrel is carried out by abutting opposed surfaces of the blank respectively with an abutment surface of the mandrel and with the folding device of the packaging unit.

The Applicant has observed that the most critical step for the integrity of the blank is the passage of the blank from the planar feeding configuration to a configuration folded on the mandrel. At this step, in fact, different panels of the blank are abutted by the mandrel and by the folding device with completely different speeds.

The Applicant has also observed that in the packaging process it is provided for applying a certain amount of glue on a flap of the blank before the folding step, so that two opposed flaps of the blank itself can be subsequently glued to form the open box.

The Applicant has found that smears or splashes of glue occur in the wrap-around packaging process. The Applicant has in fact verified that some quantities of glue are deposited on the work surfaces, or on the machinery involved in the packaging process, or arranged near the packaging unit. The Applicant has verified that this negatively affects the productivity of the packaging process, because it involves a greater frequency of interventions for the maintenance and cleaning of machinery in order to remove glue residues.

In addition, the Applicant has verified that such smears may result in a decrease in the quality of the boxes produced both due to an albeit minimal decrease in the glue available on the blank for the boxes to be glued and also due to a displacement of the glue from the application area. This causes a decrease in the gluing accuracy and sealing of the box.

These drawbacks are more evident as the dimensions of the boxes to be formed and, therefore, of the blank to be folded on the mandrel increase.

The Applicant has observed that the most critical step in the process of packaging the articles in boxes, in which smears of glue usually occur, is constituted by the first folding of the blank on the mandrel by means of the folding device.

The Applicant has therefore observed that the most critical step for this issue is precisely the passage of the blank from the planar feeding configuration to a folded configuration in which the blank is folded on the mandrel.

On the other hand, this step is usually performed at high speeds, resulting from the high production capacity required for packaging apparatuses. Therefore, in this folding step, the blank is subjected to a considerable and sudden thrust that can cause both tears of the blank and unwanted splashes of glue.

The Applicant has therefore imagined using alternative folding systems, for example by reducing the movement speed of the mandrels during the folding step so as to reduce the speed of impact with the blank and, therefore, the occurrence of tears and/or unwanted smears of glue.

However, the Applicant has verified that the possibility of using such folding systems was limited by the productivity required for the packaging apparatuses.

The Applicant has therefore understood that in order to limit the possibility of damaging the blanks during folding and to avoid unwanted smears of glue, it was necessary to rethink the packaging unit and in particular the folding device.

The Applicant has, in particular, understood that it was preferable to reduce the abutment speed between the blank and the folding device and, in particular, that in order to avoid tears or damages to the blank it was useful to reduce the relative speed between the folding device and the mandrel and, therefore, with the blank carried with the mandrel to be folded around it.

The Applicant has therefore perceived that by using a folding device movable along a stroke of the movement trajectory of the mandrel, and able to move along the same direction as the mandrel, but at a speed lower than the mandrel, the impact of the blank with the mandrel and the folding device would have been advantageously damped, thus obtaining a gentle and optimal folding of the blank around the mandrel without thereby limiting the speed of the mandrel.

The Applicant has finally found that a method and a packaging unit for packaging articles in boxes which provide for moving the mandrel along a movement trajectory at a desired movement speed and displacing the folding device along at least one folding stroke with an accompanying speed having the same direction as the movement speed of the mandrel and modulus lower than the modulus of the movement speed in the folding stroke surprisingly allow to obtain an excellent folding of the blank and to avoid unwanted smears of the glue and at the same time to maintain high production speeds.

In other words, the Applicant has found that the movement of the folding device along the folding stroke in a manner concordant to the mandrel but at a lower speed than the mandrel allows folding the blank around the mandrel while avoiding the defects complained of above.

In a first aspect thereof, therefore, the present invention is directed to a packaging unit for packaging articles in boxes.

Preferably, said unit comprises a mandrel configured to accommodate one of said articles inside it.

Preferably, such a unit comprises a movement device configured to move the mandrel along a movement trajectory at a desired movement speed.

Preferably, said packaging unit comprises a feeding device configured to feed a blank towards the mandrel along a feeding trajectory.

Preferably, the feeding trajectory intersects the movement trajectory.

Preferably, said packaging unit comprises a folding device intended to abut the blank and configured to cooperate with the mandrel to fold the blank around the mandrel when the blank is positioned between the mandrel and the folding device, so as to form one of the boxes.

Preferably, said packaging unit comprises an actuation device configured to displace the folding device along at least one folding stroke with an accompanying speed having in said folding stroke at least one accompanying component with the same direction as the movement speed of the mandrel and modulus lower than the modulus of the movement speed.

In a second aspect thereof, the present invention is directed to a packaging unit for packaging articles in boxes.

Preferably, said unit comprises a plurality of mandrels, wherein each mandrel of the plurality of mandrels is configured to accommodate one of said articles inside it.

Preferably, such a unit comprises a movement device configured to move each mandrel along a movement trajectory at a desired movement speed.

Preferably, said packaging unit comprises a feeding device configured to feed a blank towards each mandrel along a feeding trajectory.

Preferably, the feeding trajectory intersects the movement trajectory.

Preferably, said packaging unit comprises a folding device intended to abut the blank and configured to cooperate with each mandrel to fold the blank around the mandrel when the blank is positioned between the mandrel and the folding device, so as to form one of the boxes.

Preferably, said packaging unit comprises an actuation device configured to displace the folding device along at least one folding stroke with an accompanying speed having in said folding stroke at least one accompanying component with the same direction as the movement speed of each mandrel and modulus lower than the modulus of the movement speed.

In a third aspect thereof the present invention concerns a method for packaging articles in boxes.

Preferably, said method comprises providing a mandrel configured to accommodate at least one of said articles.

Preferably, said method comprises providing a folding device configured to cooperate with the mandrel to fold a blank around the mandrel, so as to form the box.

Preferably, this method comprises providing a feeding device for feeding a blank towards the mandrel.

Preferably, said method comprises depositing at least one of said articles in a mandrel.

Preferably, said method comprises moving the mandrel along a movement trajectory at a desired movement speed.

Preferably, said method comprises positioning a blank along the movement trajectory of the mandrel in an advanced position with respect to the mandrel so that the blank is interposed between the folding device and the mandrel.

Preferably, said method comprises moving the folding device along at least one folding stroke of the movement trajectory with an accompanying speed having at least one accompanying component with the same direction as the movement speed of the mandrel and modulus lower than the modulus of the movement speed in the folding stroke for folding the blank on the mandrel.

Thanks to these features, the method and the packaging unit according to the present technical solution allow to effectively fold a blank around a mandrel avoiding that the blank is torn in the folding, without however penalizing the production speed. Thanks to these features, it is also possible to avoid or limit smears of the glue present and applied on the blank. Thanks to these features it is therefore possible to obtain boxes of high quality level and at the same time to obtain high production speeds.

By moving the folding device at an accompanying speed having at least one accompanying component with the same direction as the movement speed of the mandrel and modulus lower than the modulus of the movement speed in the folding stroke, a relative motion is generated between the mandrel and the folding device that allows the blank to be folded around the mandrel in a longer time, therefore in a gentler way. The relative speed between the folding device and the mandrel is lower than the movement speed of the mandrel, therefore, the impact force applied to the blank by the folding device is reduced avoiding, or in any case drastically limiting, the occurrence of any damages to the blanks. In addition, it is possible to fold the blank on the mandrel at a desired folding speed independent of the movement speed of the mandrel. This prevents splashes of glue from the blank during folding.

These advantages are obtained without the need to decrease the movement speed of the mandrel and, therefore, the productivity of the packaging unit.

The provision of a single folding device makes it possible to obtain such advantages without excessively increasing the overall weight of the packaging unit.

The folding device is intended to cooperate in succession with the various mandrels of the plurality of mandrels to fold a corresponding blank around the respective mandrel when said blank is positioned between the mandrel and the folding device.

In a fourth aspect thereof, therefore, the present invention concerns a method for packaging articles in boxes.

Preferably, said method comprises depositing at least one of said articles in a mandrel.

Preferably, said method comprises moving the mandrel along a movement trajectory.

Preferably, said method comprises displacing a blank by means of a feeding device and positioning the blank along the movement trajectory of the mandrel in an advanced position with respect to the mandrel.

Preferably, such a method comprises providing a folding device configured to cooperate with the mandrel to fold a blank around the mandrel when the blank is positioned between the mandrel and the folding device.

Preferably, said method comprises abutting the blank with a first abutment surface of the mandrel.

Preferably, said method further comprises abutting the blank with the folding device on the opposite side with respect to the mandrel to fold the blank around the mandrel.

Preferably, said method comprises decoupling the blank from the feeding device.

Preferably, said decoupling is carried out before said abutting or said further abutting.

In a fifth aspect thereof the present invention is directed to a packaging unit for packaging articles in boxes.

Preferably, said unit comprises a mandrel configured to accommodate at least one of said articles inside it.

Preferably, the mandrel comprises a first abutment surface defined on the mandrel as the surface of the mandrel intended to abut the blank as first when positioned in the movement trajectory.

Preferably, said packaging unit comprises a movement device configured to move the mandrel along a movement trajectory.

Preferably, the movement device is configured to bring the first abutment surface against the blank into an abutment position provided on the movement trajectory.

Preferably, such a packaging unit comprises a feeding device configured to feed a blank towards the mandrel.

Preferably, said feeding device is configured to displace said blank along said movement trajectory from a feeding position to a release position.

Preferably, said packaging unit comprises a folding device intended to abut the blank in a further abutment position provided on the movement trajectory and configured to cooperate with the mandrel to fold the blank around the mandrel when the blank is positioned between the mandrel and in contact with the first abutment surface.

Preferably, the feeding device comprises a decoupling device configured to decouple the blank from the feeding device in a release position.

Preferably, said release position is provided upstream of the abutment position or of the further abutment position.

Thanks to these characteristics, the method and the packaging unit according to the present technical solution make it possible to effectively fold a blank around a mandrel avoiding on the one hand potential interferences between the components of the packaging unit and ensuring at the same time that boxes having a regular and precise shape are formed. Thanks to these features it is also possible to obtain the aforementioned advantages without penalizing the production speed.

Furthermore, it is possible to simplify the structure of the packaging unit and to reduce the inertial masses involved in the packaging method.

The present invention, in at least one of the aforementioned aspects, may have at least one of the further preferred features set forth below.

Preferably, the modulus of the accompanying component is comprised between about 10% and about 75%, more preferably between about 30% and about 60%, in a greatly preferred manner it is about 50% of the modulus of the movement speed in the folding stroke.

The relative speed between the mandrel and the folding device and, therefore, the force acting on the blank when the blank is abutted by the folding device, depends on the ratio between the modulus of the accompanying component and the modulus of the movement speed.

Preferably, the difference between the modulus of the accompanying component and the modulus of the movement speed is comprised between about 0.05 m/s and about 2 m/s, preferably between 0.1 m/s and 1 m/s.

This difference ensures that a relative motion is established between the mandrel and the folding device that allows the blank to be folded around the mandrel in the folding stroke. This relative speed also allows to gradually fold the blank, avoiding unwanted splashes of glue or tears in the blank.

In the folding stroke, the folding device moves with respect to the blank by progressively folding it on the mandrel.

Preferably the accompanying speed is parallel to the movement speed in the folding stroke.

The folding device is moved, at least in the folding stroke, parallel to the mandrel. In this way, it is possible to maximize the folding precision of the blank around the mandrel. In this case, the accompanying component coincides with the accompanying speed.

Preferably, the movement speed is constant along the folding stroke.

Preferably, the accompanying speed is constant along the folding stroke.

Preferably, both the movement speed and the accompanying speed are constant along the folding stroke. In this way it is possible to establish and maintain a constant difference between the modulus of the accompanying speed and the further modulus of the movement speed. This version allows to simplify the packaging unit according to this technical solution.

In some embodiments, the modulus of at least one between the movement speed and the accompanying speed varies in the folding stroke. In this way it is possible to vary the relative speed between mandrel and folding device. It is possible, for example, to increase the relative speed between the folding device and the mandrel in the folding stroke, by starting the folding step with a low relative speed between the mandrel and the folding device so as to avoid unwanted splashes of glue and, subsequently, to increase the relative speed along the folding stroke to make the folding step faster. This makes the folding step faster without risking damaging the blank and/or causing smears of glue. In this way the blank is subjected to a more limited force when it is in the planar configuration so that the first folding which, as seen, is the most critical step, is carried out at a limited speed.

Preferably, the actuation device is configured to displace the folding device along a first portion of the folding stroke in which the folding device is spaced apart from the blank and a second portion of the folding stroke in which the folding device is in contact with the blank to fold said blank on said mandrel. The first portion of the folding stroke and the second portion of the folding stroke are placed in succession in the folding stroke. Preferably, a point of abutment is defined on the folding stroke which separates the first portion from the second portion and in which the folding device abuts the blank.

The folding device is moved for the first portion of the folding stroke along the movement trajectory in a position spaced apart from the mandrel and, subsequently, along the second portion, in a position overlapped on the mandrel. Along the first portion of the folding stroke the distance between the folding device and the mandrel is progressively reduced up to the abutment position in which the folding device abuts the blank. In the first portion of the folding stroke the mandrel is in a backward position with respect to the folding device, and vice versa the folding device is in an advanced position with respect to the mandrel. Conversely, in the second portion of the folding stroke the mandrel and the folding device are at least partially overlapped with respect to the movement trajectory and the folding device is in contact with the blank.

It should be noted that when the folding device abuts the blank, the folding device is moved at an accompanying speed having at least one component that is concordant to the movement speed. This improves the contact between the blank and the folding device. Furthermore, since at the time of the contact between the mandrel and the folding device, the folding device and the mandrel are moving in a manner at least partially concordant, the contact between the mandrel, blank and the folding device is smooth, i.e. substantially free of sudden strokes.

The possibility of unwanted displacements of the blank downstream of the release position is extremely reduced or even eliminated.

It is therefore not necessary to slow down the mandrel before contact between the blank and folding device. Unwanted slowdowns in the operation of the packaging unit are therefore avoided.

Preferably, the modulus of the accompanying component is comprised between 10% and about 75%, more preferably between about 30% and about 60%, in a greatly preferred manner it is about 50% of the modulus of the movement speed in the first portion of the folding stroke.

Preferably, the modulus of the accompanying component is comprised between 50% and 75% of the modulus of the movement speed in the second portion of the folding stroke.

In some versions, the actuation device is configured to actuate the folding device along the folding stroke between a first position and a second position at the accompanying speed and to further actuate the folding device from the second position to the first position at a return speed in approach to the mandrel.

Preferably the return speed has at least one return speed component having direction opposite to the movement speed.

Preferably, the return speed has direction opposite to the accompanying speed.

Preferably, the return speed has direction opposite to the movement speed.

In some versions, the movement device is configured to move the mandrel along an advancement plane. Preferably the advancement plane is a horizontal plane.

Preferably the folding device is moved parallel to an advancement plane of the mandrel.

The packaging unit preferably comprises a plurality of mandrels, each mandrel being configured to accommodate at least one of said articles inside it.

The packaging unit preferably comprises a single folding device intended to cooperate in succession with each mandrel of the plurality of mandrels.

In this way, each mandrel of the plurality of mandrels is moved along a feeding trajectory and interacts with the folding device for a stroke of the movement trajectory to fold the blank on the mandrel.

Furthermore, in the folding stroke, the folding device interacts with a mandrel of the plurality of mandrels and, therefore, with a blank. By subsequently moving the folding device from the second position towards the first position the folding device is approached to a further mandrel, so that, in the subsequent movement in the folding stroke, the folding device interacts with a further mandrel of the plurality of mandrels to fold a further blank around the corresponding mandrel.

In this way it is possible to simplify the structure of the packaging unit of the invention by reducing the number of the devices and, therefore, the weight thereof.

In some versions the mandrel is mounted on a first support structure and the folding device is mounted on a second support structure distinct from the first support structure.

In some versions the packaging unit comprises a carousel, forming said first support structure, rotating about a preferably vertical axis of rotation on which the mandrels of the plurality of mandrels are mounted and a fixed frame on which the folding device is mounted.

In some versions, the folding device comprises a first folding element and a second folding element.

Preferably the first folding element and the second folding element are arranged so as to abut respectively a first panel and a second panel of the blank. Preferably the first panel and the second panel of the blank are provided on opposite sides of the blank with respect to the advancement plane defined by the mandrel when it is moved along the movement trajectory. The first and second panels of the blank are intended to form two opposed faces of the box and are folded respectively on two opposed faces of the mandrel.

In this way it is possible to improve the folding of the blank around the mandrel.

Preferably the first and second folding elements are positioned symmetrically with respect to the advancement plane of the mandrel. In this way the blank is folded symmetrically with respect to the advancement plane and the possibility of unwanted displacements of the blank is avoided.

Preferably, the first and second folding elements are positioned in a position substantially corresponding to the movement trajectory so as to respectively abut the first and second panel substantially simultaneously. In this way, the blank is kept in the desired position and unwanted slippages of the blank with respect to the movement trajectory are avoided.

Preferably, at least one of said first folding element and second folding element comprises a folding portion shaped to interact with the blank and a movement arm extending from the folding portion and coupled to the actuation device to actuate the at least one of said first and second folding element.

Preferably, both the first and second folding element comprise a folding portion shaped to interact with the blank and a movement arm extending from the folding portion and coupled to the actuation device to actuate the folding element.

In some preferred versions the actuation device comprises first and second actuation elements intended to actuate respectively the first and the second folding element.

Preferably the first actuation element comprises a motor for actuating the first folding element.

Preferably the second actuation element comprises a further motor for actuating the second folding element.

In this way it is possible to actuate the first and second folding element independently of each other. It is possible to actuate the first and the second folding element with accompanying speed having modulus and/or direction that are different from one another.

Preferably, the first actuation element is configured to actuate the first folding element at a first accompanying speed and the second actuation element is configured to actuate the second folding element at a second accompanying speed that is different from said first accompanying speed.

Preferably the second actuation element is configured to actuate the second folding element at a second accompanying speed having the same direction as the first accompanying speed and a second modulus lower than a first modulus of the first accompanying speed.

Preferably the second folding element is carried by the second actuation element in order to be dragged into movement with the first folding element.

This simplifies the operation of the folding device.

In some versions, the first and second actuation elements are configured to actuate the first and second folding elements at the same speed, preferably in a synchronised manner.

Preferably the first folding element is arranged above the advancement plane of the mandrel and the second folding element is arranged below the advancement plane of the mandrel.

In one embodiment, one of the first and second folding elements is fixed with respect to the movement trajectory.

Preferably the folding element arranged below the advancement plane is fixed with respect to the folding trajectory.

Preferably the packaging unit further comprises a guide device provided downstream of the folding device and intended to guide the box being formed to avoid unwanted openings thereof.

Preferably the guide device comprises a first plate and a second guide plate that are spaced apart so as to define a housing for slidably accommodating the mandrel. The housing preferably has a size such as to allow the mandrel to slide while avoiding at the same time the opening of the box.

The first plate and the second guide plate are positioned on opposite sides with respect to the advancement plane of the mandrel and are intended to act as abutment elements respectively for the first and second portion of the blank.

The presence of the guide device makes it possible to avoid the unwanted opening of the box being formed on the mandrel before two opposed flaps of the blank are glued together to close the box.

The mandrel, provided with the article and the blank at least partially wrapped on it, is moved in the housing up to a gluing area in which the flaps of the blank are glued to form a closed ring box. In such a displacement the side panels of the blank would tend to open by effect of the elastic return of the material of the blank being displaced with respect to the folding position on the mandrel. The presence of the guide device allows to keep the blank wrapped on the mandrel avoiding the displacement of the side panels of the blank with respect to the mandrel.

In some versions, the packaging unit comprises an adjustment device for adjusting the extension of the folding portion of at least one between the first and second folding elements. In this way, it is possible to vary the extension of the blank portion with which the folding portion interacts. It is therefore possible to adapt the extension of the folding portion to the length of the blank in use in the packaging unit. This makes it possible to optimise the folding process while preserving the integrity of the blank.

Preferably, the folding portion comprises an impact surface intended to abut the blank and having a rounded shape, preferably convex towards the blank.

Preferably, the folding portion is provided with bevelled edges forming an angle comprised between about 30° and about 60°, preferably about 45° with the blank or with rounded edges.

This measure allows the integrity of the blank to be preserved even if it is fragile.

The impact surface is preferably made of low friction coefficient material, so as to favour the sliding of the impact surface on the blank. Preferably the impact surface is made of plastic or metallic material, or stainless steel.

The mandrel preferably comprises a first abutment surface defined on the mandrel as the most advanced surface of the mandrel, that is intended to abut the blank as first when positioned in the movement trajectory.

In a preferred version, the packaging unit comprises a retaining device displaceable between an operating position in which the retaining device is approached to the first abutment surface of the mandrel to retain the blank against the first abutment surface and a non-operating position in which the retaining device is spaced apart from the first abutment surface.

Preferably, the packaging unit further comprises an actuation element configured to displace the retaining device along an actuation trajectory to bring it towards the operating position.

Preferably the actuation trajectory comprises a transverse stroke arranged transversely to the movement trajectory of the mandrel. In this way the retaining device can be displaced with respect to the movement trajectory of the mandrel when not in use so as to avoid unwanted interferences with the mandrel.

The transverse stroke is preferably parallel to the advancement plane defined by the mandrel when moved along the movement trajectory. The actuation member is configured to displace the retaining device along an advancement trajectory having a transverse stroke parallel to the advancement plane.

In a preferred version the transverse stroke is perpendicular to the advancement plane defined by the mandrel when moved along the movement trajectory. The actuation member is configured to displace the retaining device along an advancement path having a transverse stroke perpendicular to the advancement plane.

Preferably, the actuation trajectory comprises a thrust stroke arranged parallel to the movement trajectory of the mandrel.

In this way the retaining device can be approached to the mandrel to retain the blank against the mandrel.

In some preferred embodiments, the actuation trajectory is curvilinear, preferably, the trajectory comprises a circumferential stroke. The curvilinear actuation trajectory is arranged so that a transverse stroke arranged transversely to the movement trajectory of the mandrel and a thrust stroke arranged parallel to the movement trajectory of the mandrel can be identified.

Preferably, the actuation member is configured to displace the retaining device along an actuation trajectory in which the transverse stroke is arranged radially with respect to the movement trajectory of the mandrel.

Preferably, the feeding device comprises one or more suction cups for retaining the blank by suction. In other versions, different feeding devices such as retaining grippers, belts or feeding belts can be provided to feed the blank to the mandrel.

Preferably the feeding device is configured to displace the blank along a feeding trajectory which intersects the movement trajectory.

Preferably, the feeding device is configured to displace the blank along the feeding trajectory in an almost planar configuration. In this way, the blank is released by the feeding device in an almost planar configuration and is abutted by the folding device or by the mandrel in an almost planar configuration.

In one version, the feeding device is configured to move the blank along a feeding trajectory comprising at least one radial feeding stroke arranged radially with respect to the movement trajectory of the mandrel.

Preferably the radial feeding stroke has a direction opposed to the actuation transverse stroke of the retaining device. In this way, a particularly efficient packaging unit is obtained with limited overall dimensions and in which the possibilities of interference with the provided members are minimized.

Preferably the radial feeding stroke has a direction concordant to the actuation transverse stroke of the retaining device. In this way, a packaging unit that is particularly efficient in engaging the blank and retaining the blank against the mandrel is obtained.

The retaining device is preferably operatively associated with the movement device to carry the retaining device along the movement trajectory. In this way, the retaining device is carried together with the mandrel along the movement trajectory, despite being displaceable with respect to the mandrel. This optimises the operating precision of the packaging unit according to the invention.

Preferably, the retaining device comprises a lamina having a retaining surface having a shape similar to the first abutment surface of the mandrel. Preferably, the retaining surface is shaped so as to couple, in the operating position, with shape coupling with the first abutment surface.

In some preferred versions the feeding device comprises at least one suction element for retaining the blank by depression.

Preferably, the feeding device comprises at least one retaining element configured to retain the blank by suction.

The provision of a retention element to retain the blank allows to further simplify the packaging unit, simplifying the blank release step.

Preferably, the feeding device comprises a plurality of retaining elements arranged to retain the blank in distinct portions thereof.

In some versions there is provided a control unit operatively associated with the feeding device and configured to actuate/lock the suction element to retain/release the blank.

In one embodiment, the abutment position is provided upstream of the further abutment position.

In this way, the blank is first abutted by the mandrel and subsequently by the folding device.

In one embodiment, the release position is provided upstream of the abutment position.

In this way, the blank is released by the feeding device before being abutted by the mandrel and, possibly, also before being abutted by the folding device.

In one embodiment, the release position is provided upstream of both the abutment position and the further abutment position.

In this case, the blank albeit for a short interval of time is not retained by the feeding device and is neither abutted by the folding device nor by the mandrel.

In the release position the blank is in a substantially planar configuration, i.e. not folded.

Preferably the release position is provided downstream of the abutment position and upstream of the further abutment position.

The blank is released by the feeding device before being further abutted by the folding device. In this way it is possible to move the feeding device to move it away from the movement trajectory in order to avoid any interferences with the folding device. Since when the feeding device is moved away from the blank it is abutted by the mandrel, it is prevented that the blank moves substantially from the position in which it was positioned by the feeding device. In this case, the blank is transported between the release position and the further abutment position by the mandrel held on it by the friction generated by the movement along the movement trajectory.

In one embodiment, the abutment element position is provided downstream of the further abutment element position.

Preferably the release position is provided downstream of the further abutment position and upstream of the abutment position. In this way it is possible to move the feeding device to move it away from the movement trajectory in order to avoid any interferences with the mandrel.

Since when the feeding device is moved away from the blank when it is abutted by the folding device, it is prevented that the blank moves substantially from the position in which it was positioned by the feeding device. In this case the blank is transported between the release position and the abutment position by the folding device.

In some preferred versions, it is provided to move the mandrel along a movement trajectory having a curvilinear shape, preferably along a movement trajectory comprising a portion of circular trajectory.

Preferably, it is provided to displace the folding device with an accompanying speed that is parallel to the movement speed in the folding stroke.

In some preferred versions it is provided to displace the first folding element and the second folding element at the same accompanying speed.

In some preferred versions it is provided to displace the first folding element and the second folding element in a synchronised manner.

In some preferred versions it is provided to displace the first folding element and the second folding element independently of each other.

Preferably, said movement comprises moving the folding device with an accompanying speed that is parallel to the movement speed in the folding stroke.

In some preferred versions it is provided to move the first folding element and the second folding element at the same accompanying speed.

In some preferred versions it is provided to move the first folding element and the second folding element in a synchronised manner. In this way, the first and second folding elements abut the blank almost at the same time. This avoids unwanted displacements of the blank.

In some preferred versions, it is provided to actuate the first folding element at a first accompanying speed and to further actuate the second folding element at a second accompanying speed, the second accompanying speed having the same direction as the first accompanying speed and a second modulus lower than a first modulus of the first accompanying speed.

In some preferred versions, it is provided to move the mandrel along a movement trajectory having a curvilinear shape, preferably along a movement trajectory comprising a portion of circular trajectory.

Preferably, said abutting is provided before said further abutting.

In some versions, said decoupling is provided before said abutting and said further abutting. Thus, for a certain period of time the blank is neither engaged by the mandrel nor by the folding device and is not retained by the feeding device.

Preferably said decoupling is provided after said abutting and before said further abutting. In this way, for a certain period of time the blank is engaged only by the mandrel.

Preferably said abutting is provided after said further abutting.

Preferably said decoupling is provided after said further abutting and before said abutting. In this way, for a certain period of time the blank is engaged only by the folding device.

Preferably, it is provided to carry said feeding device along said movement trajectory for an accompanying stroke, said carrying being provided between said positioning and said decoupling.

Preferably, said decoupling comprises interrupting the suction of said at least one suction element.

Preferably, said feeding comprises feeding said blank along a feeding trajectory comprising at least a radial feeding stroke arranged radially with respect to the movement trajectory of said mandrel.

It should be noted that some steps of the methods described above may be independent of the order of execution reported. In addition, some steps may be optional. In addition, some steps of the methods may be performed repetitively, or they may be performed in series or in parallel with other steps of the method.

The characteristics and advantages of the invention will become clearer from the detailed description of a preferred embodiment thereof, by way of non-limiting example, with reference to the appended drawings wherein.

Figure 3:
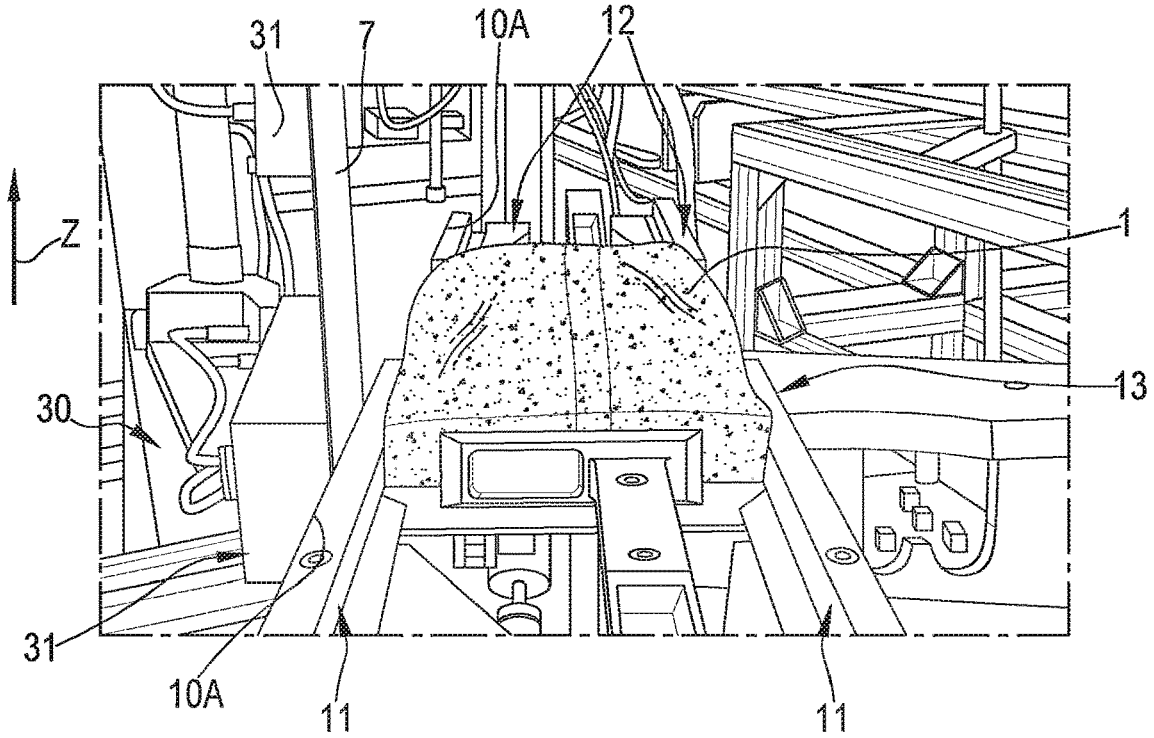
FIG. 3-5 are partial schematic views of a folding device and of a mandrel of the packaging unit of FIG. 1 and of a blank in three distinct positions of use.
Figure 4:
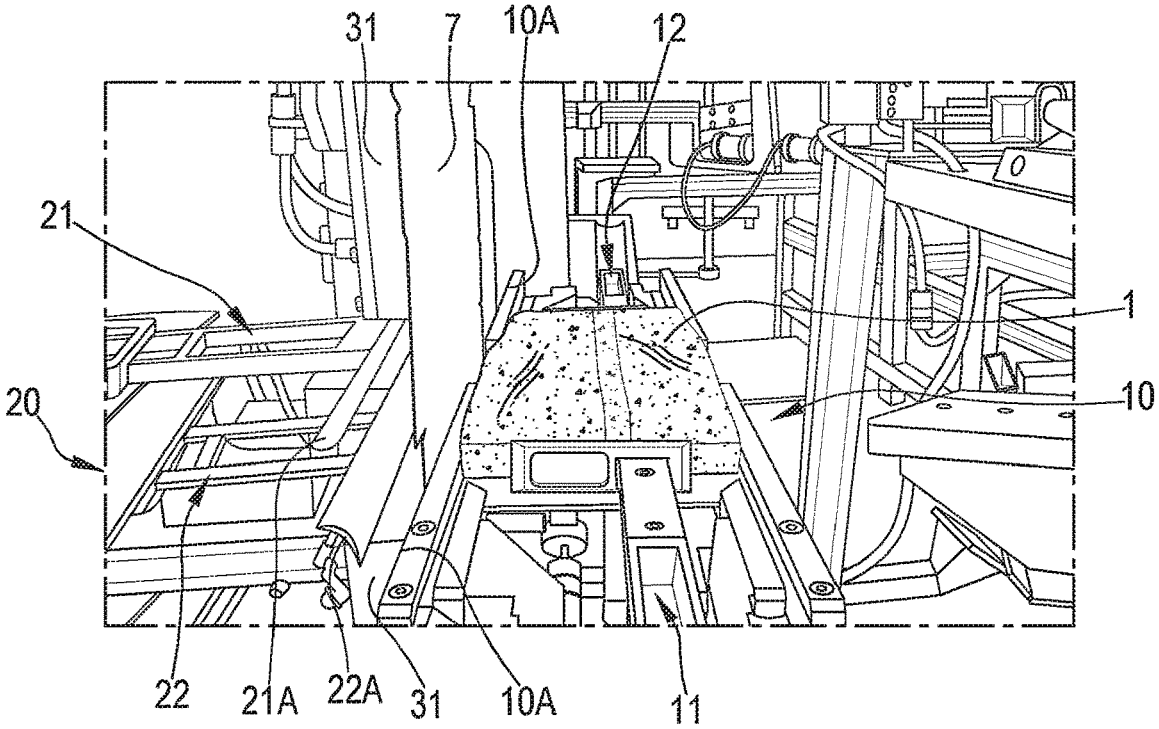
Figure 5:
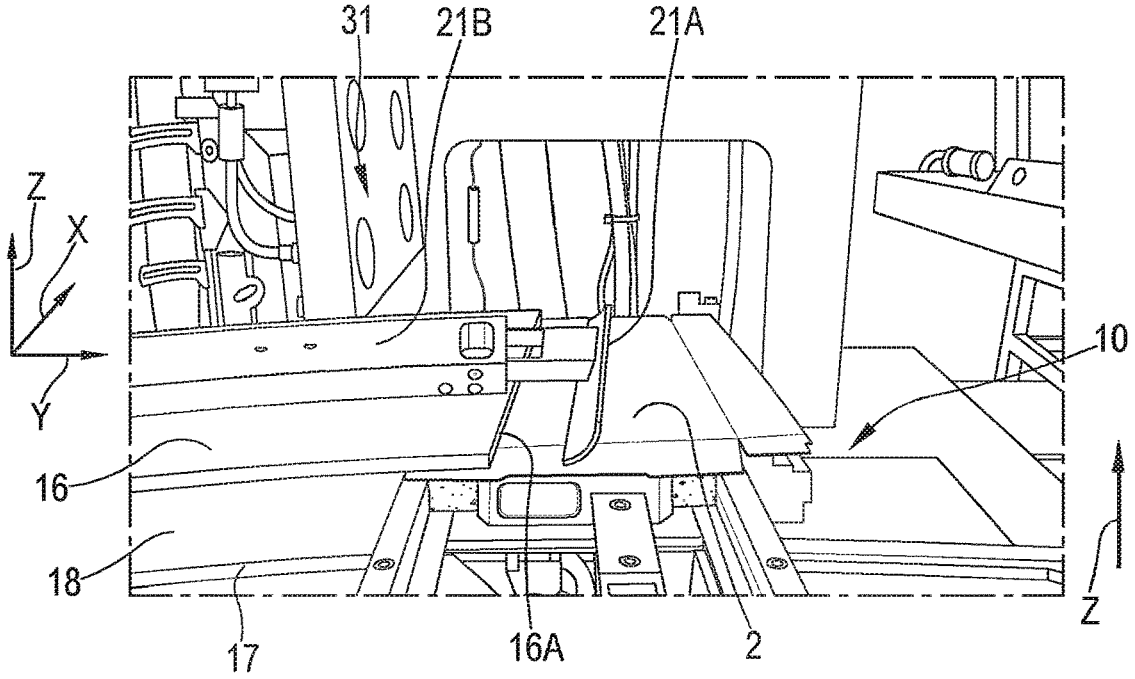

In the accompanying figures, a packaging unit made in accordance with this solution is indicated as a whole with 100. The packaging unit 100 is of the "wrap-around" type, performing the packaging by wrapping a box around an article 1 to be packaged. In the present example the article 1, better visible in FIG. 3 or 4, consists of one or more flexible bags, filled with predetermined quantities of bulk products in the form of a discrete particulate consisting of granules and/or corn flakes and suitably sealed. The box 2, better visible in FIG. 5, is formed by wrapping a blank 7 around a mandrel 10 bearing the article 1, as better clarified below.

The packaging unit 100 is provided to move objects along a process direction indicated with F in the Figures.

The packaging unit 100 is fed by a straight conveyor belt 101 on which the articles 1 to be packaged are conveyed, which in the present example consist of the bags described above, coming from the respective filling and sealing plant. The conveyor belt 101 transports the articles 1 to a first unloading end 102 at which the articles 1 are picked up by a transfer carousel 103 which is provided to pick up an article 1 to be packaged from the conveyor belt 101 and to transfer it to the packaging unit 100 in which the execution of a wrapping step of a box is provided, as better clarified below.

The packaging unit 100 comprises in its more general units a forming carousel 3 which is provided to receive the articles 1 from the transfer carousel 103 and to form a box 2, a feed carousel 5 for feeding blanks 7 to the forming carousel 3 and an outlet carousel 6, intended to pick up the boxes 2 formed by the forming carousel 3 and to deposit them on an evacuation belt 8 through which the boxes 2 are transported to subsequent processing units provided in the packaging unit 100.

Figure 1:
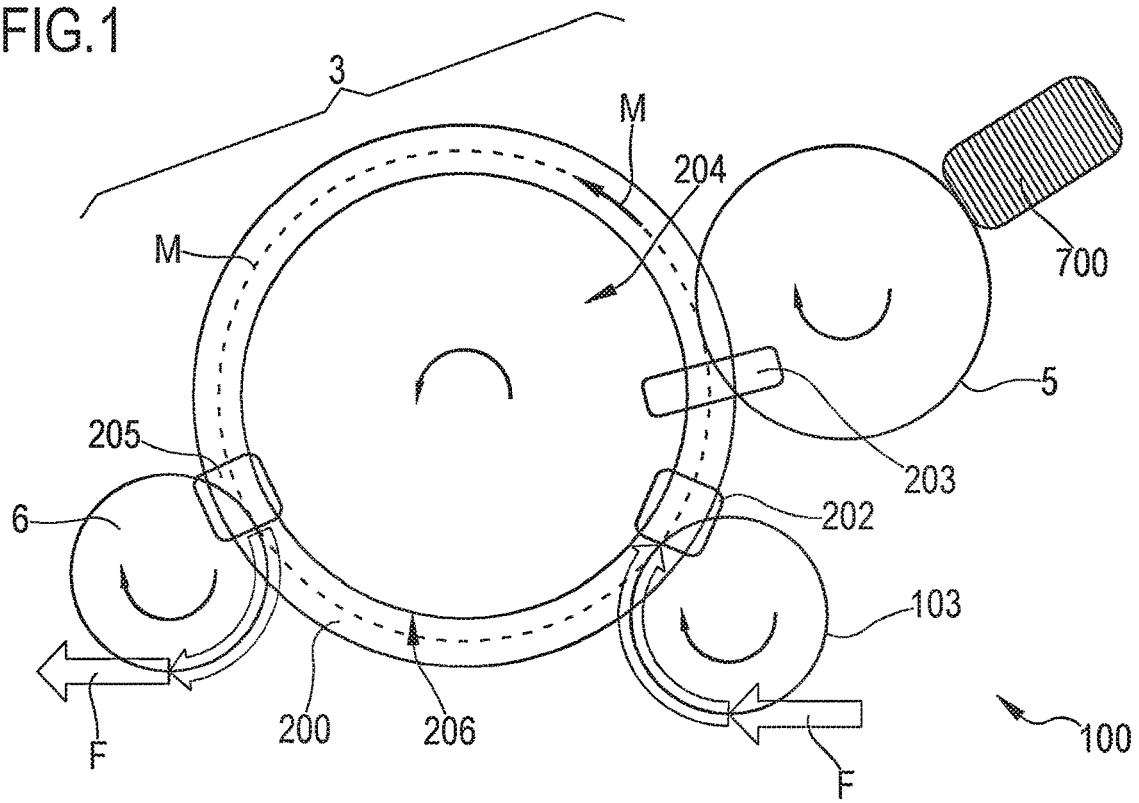
FIGS. 1 and 2 are two schematic plan views of an embodiment example of a packaging unit in accordance with the present solution.
Figure 2:
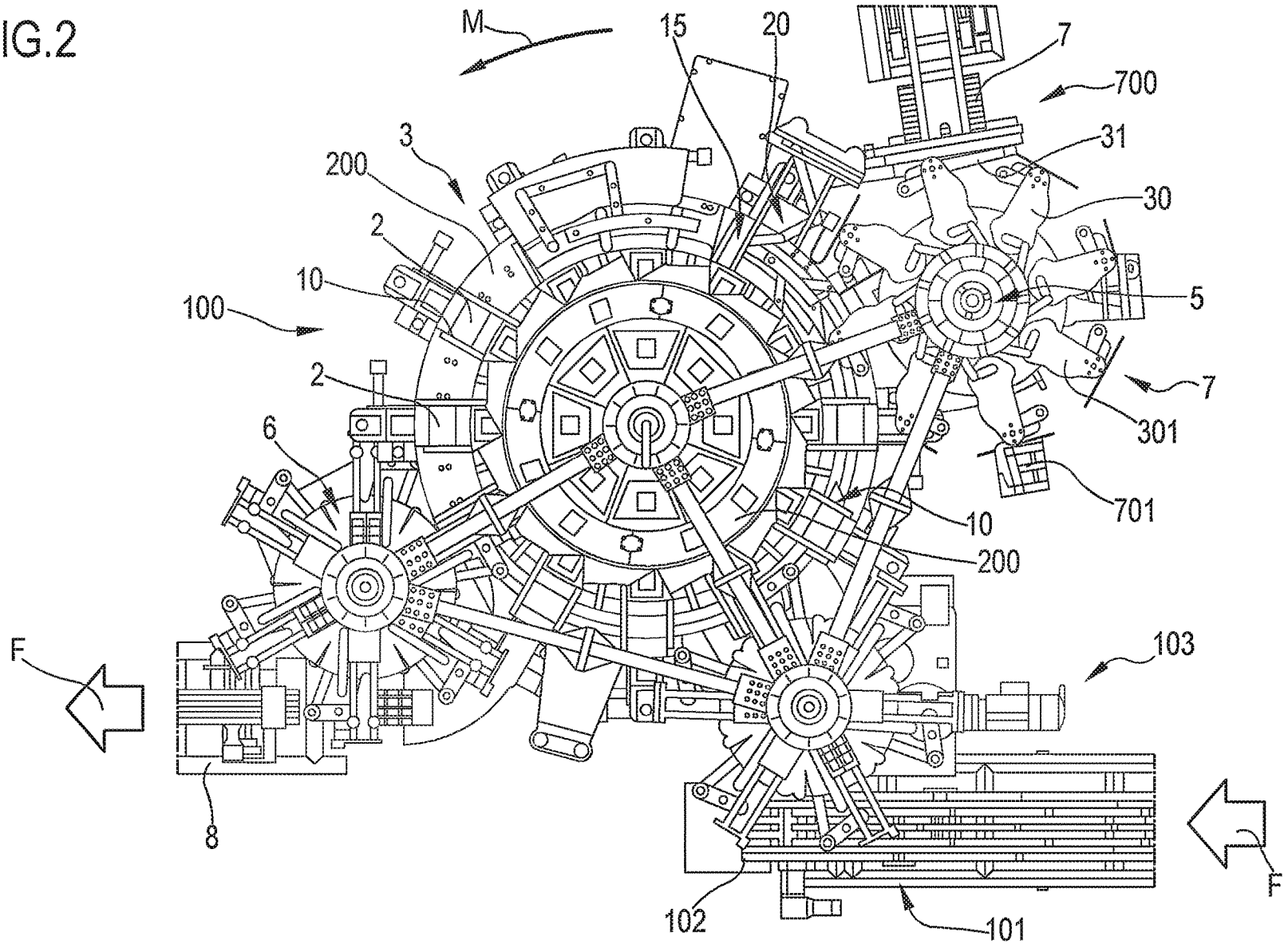

The forming carousel 3, the feed carousel 5 and the outlet carousel 6 are brought into rotation, by means of respective movement devices not shown, in order to be rotatable about respective axes of rotation which are substantially parallel to a vertical direction that is indicated in the figures generally with Z and that is perpendicular to the plane of FIGS. 1 and 2.

The forming carousel 3 is provided with a plurality of mandrels 10, each mandrel 10 is configured to accommodate one of the articles 1 inside it and is operatively connected to a movement device of the forming carousel 3 to be displaced along a movement trajectory M at a desired movement speed VM, as better explained below. The movement trajectory M lies on an advancement plane 200 of the mandrel 10 and is a line oriented in the shape of an arc of circumference. The movement speed VM is a vector having at each point a direction tangent to the movement trajectory M and a desired modulus M2 which is constant along the movement trajectory M as best schematized in FIG. 10A-10B. The advancement plane of the mandrel 200 has an XY orientation in an orthogonal Cartesian reference system XYZ.

The feeding carousel 5 comprises a plurality of feeding devices 30, each configured to feed a blank 7 towards a mandrel 10. Each feeding device 30 is configured to pick up a single blank 7 from a group of blanks stacked in a hopper 700 and to bring it to the forming carousel 3 and is configured to feed the blank 7 along a feeding trajectory which intersects the movement trajectory M. Each feeding device 30 comprises a plurality of retaining elements 31 arranged to retain the blank 7 in different portions thereof. Each retaining element 31 comprises a suction cup, not shown in the Figures, operatively connected to a suction device, also not visible in the Figures, and arranged to releasably retain a desired portion of a blank, as better clarified below. An application device 701 is also provided which is intended to apply a desired amount of glue on an edge portion 7D of the blank 7, when the blank 7 is retained on a retaining device 30 before feeding it to the forming carousel 3.

The packaging unit 100 further comprises a folding device 20, better visible in FIGS. 6 and 7, intended to abut the blank 7 and configured to cooperate with the mandrel 10 to fold the blank 7 around the mandrel 10, as better clarified below. The packaging unit 100 further comprises an actuation device 40 configured to displace the folding device 20 along at least one folding stroke P which, in the version shown, is defined on the movement trajectory M of the mandrel 10.

The packaging unit 100 further comprises a guide device 15, provided immediately downstream of the folding device 20 and comprising a first guide plate 16 and a second guide plate 17 that are mutually facing and defining a housing 18 for a box to be formed. The first guide plate 16 and the second guide plate 17 extend for a guide stroke G of the movement trajectory M. The first guide plate 16 and the second guide plate 17 extend respectively between a first end 16A, 17A and a second end 16B, 17B, the first end 16A, 17A being provided in a backward position with respect to the second end 16B, 17B and the first guide plate 16 and the second guide plate 17 allow to maintain the shape of the box 2 being formed avoiding unwanted openings thereof. The first end 16A, 17A of the first 16 and second plate 17 define the inlet for the housing 18 through which the mandrel 10 enters the housing 18.

Each mandrel 10 is carried along the movement trajectory M between a receiving zone 202, in which the mandrel 10 receives an article 1 from the transfer carousel 103, an abutment zone 203, in which the mandrel 10 abuts a blank 7 supplied by the feeding device 30 in a first abutment position R1, a forming zone 204, in which the blank 7 is folded on the mandrel so as to form a box 2 containing the article 1, an unloading zone 205, in which the box 2 containing the article 1 is deposited on the outlet carousel 6 and, finally, a return zone 206 in which the mandrel 10 is returned to the receiving zone 202. From the outlet carousel 6, the box 2 is then deposited on the evacuation belt 8 to be transported to the subsequent processing stations.

Figure 9:
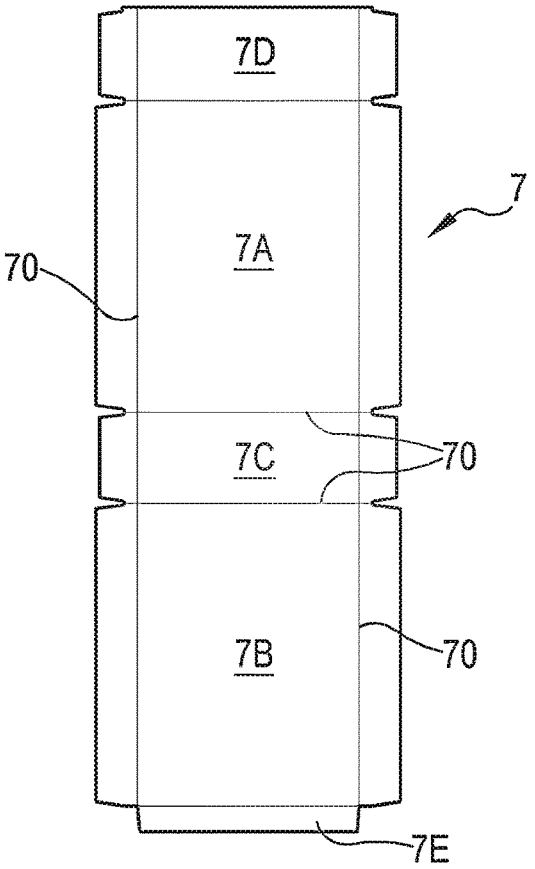
FIG. 9 is a schematic view of a blank usable in the packaging unit of FIG. 1

The blank 7, better visible in FIG. 9, is made of cardboard with a thickness comprised between 0.4 and 0.8 mm, in this case about 0.5 mm, and is suitably shaped to form a box 2 when folded around the mandrel 10. For this purpose, folding lines 70 are obtained on the blank 7 that divide the blank 7 into a plurality of panels 71 intended to form, alone or in combination with each other, the different faces of the box 2. The folding lines 70 are preferably creases and each pair of adjacent panels 71 is oscillatable around a respective folding line 70 that separates them. In particular, as better visible in FIG. 9, an intermediate panel 7C is identified in the blank 7 that is intended to be abutted as first by the mandrel 10, as well as a first and a second panel 7A, 7B respectively extended on two opposed sides of the intermediate panel 7C, and separated therefrom by respective folding lines 70, a third panel 7D positioned so that the first panel 7A is interposed between the third panel 7D and the intermediate panel 7C and a closing panel 7E positioned so that the second panel 7B is interposed between the closing panel 7E and the intermediate panel 7C. The first and second panels 7A, 7B are intended to form two opposed faces of the box 2. The first and second panels 7A, 7B are intended to be folded on the mandrel 10 on opposite sides with respect to the advancement plane 200, as better clarified below. On an edge portion of the third panel 7D it is provided to apply glue for the closure of the box 2.

The mandrel 10 comprises a first unit 11 and a second unit 12, which are distinct and separated from each other, both mounted on an arm not extended radially by the movement carousel 3 and passing below a fixed work surface 9 of the packaging unit 100.

The first unit 11 and the second unit 12 are positioned so as to define an accommodation seat 13 for an article 1 to be transported. Advantageously, the first 11 and the second unit 12 are displaceable with respect to each other so as to define an accommodation seat 13 for the articles 1 with variable dimensions.

The mandrel 10 further comprises a first abutment surface 10A defined as the surface of the mandrel 10 intended to be the first to abut the blank 7 when the latter is positioned in the movement trajectory M. The first abutment surface 10*a* is the surface of the mandrel 10 provided in the further advanced position along the movement trajectory M.

Figure 6:
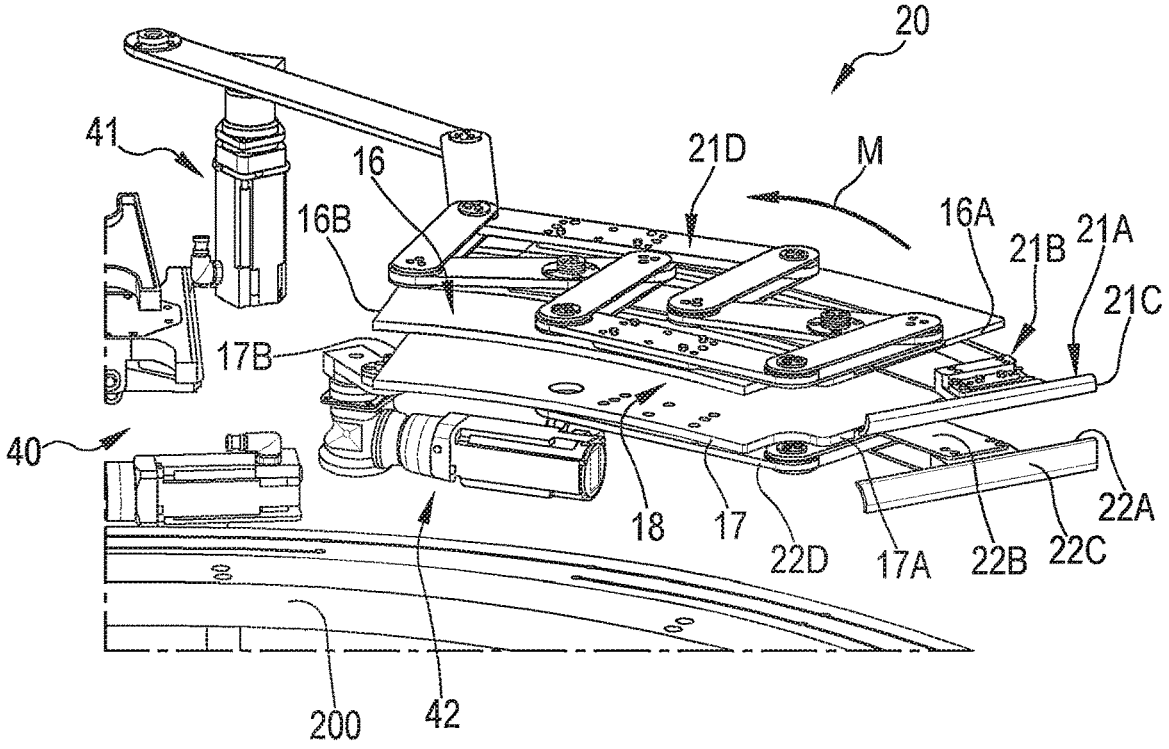
FIG. 6-7 are partial schematic views of a folding device of the packaging unit of FIG. 1 respectively in a first position and in a second position.
Figure 7:
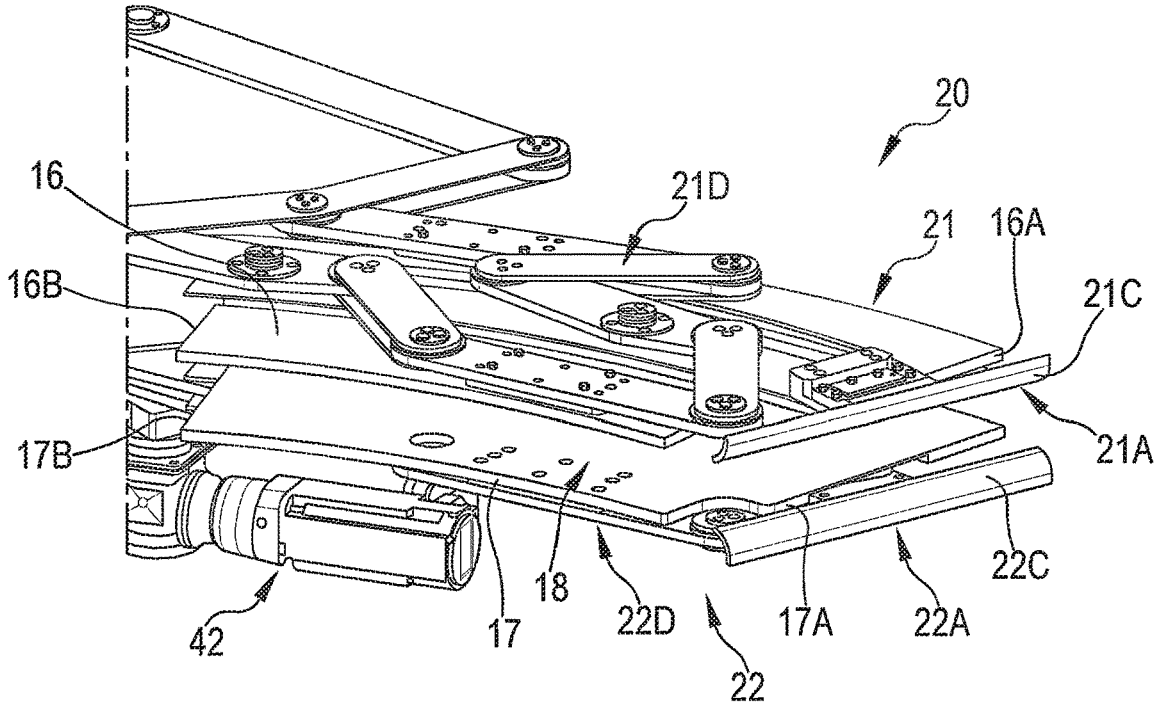
Figure 8:
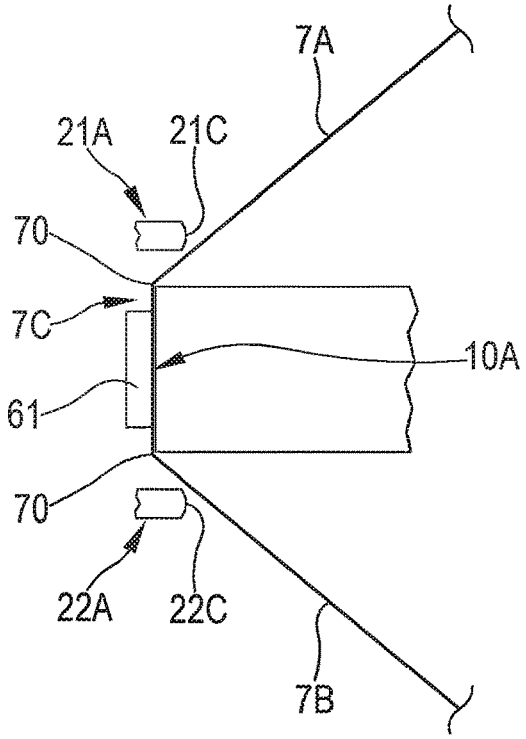
FIG. 8 is a schematic figure of a folding device and of a mandrel of the packaging unit of FIG. 1 and of a blank in a position of use.

The folding device 20, better visible in FIGS. 6-8, comprises a first folding element 21 and a second folding element 22 which are arranged to abut respectively the first panel 7A and the second panel 7B of the blank 7. The first and second folding elements 21, 22 are positioned so as to respectively abut a first and a second panel of the blank 7 which are positioned on opposite sides with respect to the advancement plane 200 defined by the mandrel 10.

The first folding element 21 comprises a folding portion 21A shaped to interact with the blank 7 and a movement arm 21B extending from the folding portion 21A and intended to be coupled to the actuation device 40 to actuate the first folding element 21.

Similarly, the second folding element 22 comprises a second folding portion 22A shaped to interact with the blank 7 and a second movement arm 22B extending from the folding portion 22A and intended to be coupled to the actuation device 40 to actuate the second folding element 22.

The folding portion 21A, 22A is made integral with the respective movement arm 21B, 22B.

The actuation device 40 comprises an actuation motor 41 coupled to the first folding element 21 through a first movement member 21D for transmitting motion from the actuation motor 40 to the first folding element 21, and a second transmission element 42 coupled to the second folding element 22 through a second movement member 22D. The transmission element 42 is operatively interposed between the actuation motor 41 and the second movement arm 22B so as to transmit motion from the actuation motor 41 to the second movement arm 22B. The first and second movement members 21D, 22D comprise a plurality of mutually hinged levers to form an articulated polygon movement member.

The first 21 and the second folding element 22 are associated respectively with the first 16 and the second guide plate 17. This measure increases the stability of the folding device 20 and optimises the folding of the box avoiding unwanted openings.

In a version not shown there is provided a first actuation motor for actuating the first folding element and a second actuation motor for actuating the second folding element.

Each folding portion 21A, 22A defines a respective first impact surface 21C, 22C of the blank 7 against the respective folding element 21, 22. The first impact surface 21C, 22C is the surface of each folding element 21, 22 which abuts the blank 7 as first when positioned on the movement trajectory M.

The first impact surface 21C, 22C has a rounded shape, convex towards the blank 7 with a curvature such as to form with the blank an angle of about 45°. The first impact surface 21C, 22C is made of low friction coefficient material, usually plastic, or metallic material. In some versions the first impact surface 21C, 22C is made of stainless steel.

Each folding element 21, 22 comprises an adjustment element, not visible in the figures, for adjusting the extension of the first impact surface 21C, 22C along an adjustment direction transversal to the movement trajectory M to vary the portion pf the blank 7 which is abutted by the first impact surface 21C, 22C.

The actuation device 40 is configured to move the folding device 20 alternately in a direction concordant to the movement trajectory M and in a direction opposite to the movement trajectory M.

Figure 10A:
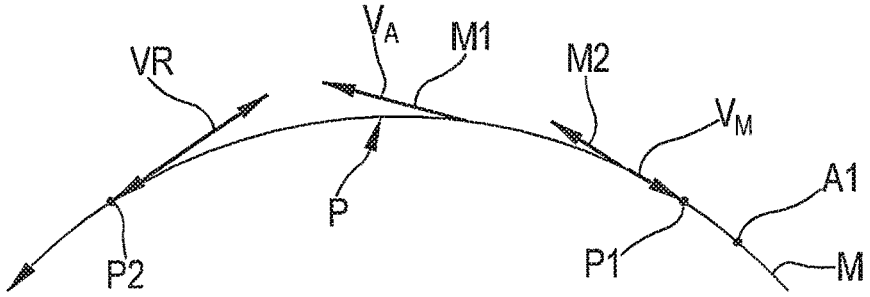
FIGS. 10A and 10B are two interrupted graphs of a movement trajectory of the packaging unit of FIG. 1.
Figure 10B:
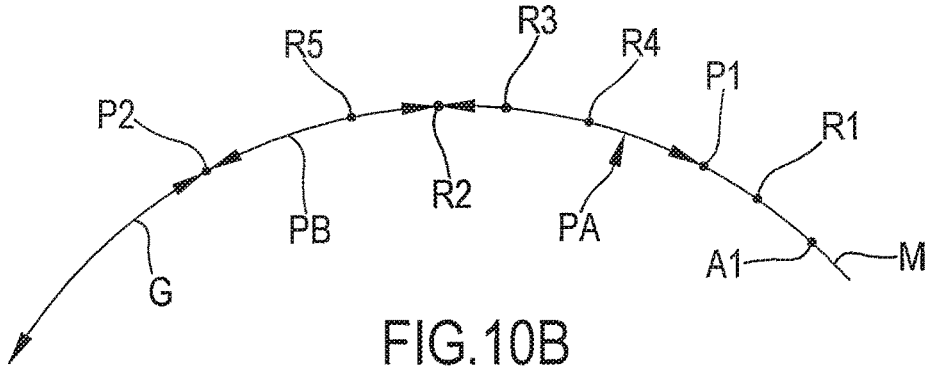

In particular, as better schematized in FIGS. 10A and 10B, the folding device 20 is moved along the folding stroke P in a direction concordant to the movement trajectory M with an accompanying speed Va to fold the blank 7 on the mandrel 10 and along the folding stroke P in a direction contrary to the movement trajectory M with a return speed VR so as to be brought towards the mandrel 10.

The folding device 20 is movable along the folding stroke P between a first position P1 which corresponds to the further backward position of the folding device 20 along the movement trajectory M and a second position P2 which corresponds to the most advanced position of the folding device 20 along the movement trajectory M. The second position P2 is provided near the first end 16*a*, 17A of the first 16 and the second plate 17.

The actuation device 40 moves the folding device 20 from the second position P2 to the first position P1 with a return speed VR to bring it towards the mandrel 10 and moves the folding device 20 from the second position P2 to the first position P1 with an accompanying speed concordant to the movement speed VM to fold the blank 7.

In particular, the actuation device 40 moves the folding device 20 in succession along a first portion PA of the folding stroke P between the first position P1 and an abutment position R2 and along a second portion PB of the folding stroke P between the abutment position R2 and the second position P2. In the first portion PA the folding device 20 is spaced apart from the mandrel 10 and from the blank 7, while in the second portion PB the folding device 20 is in contact with the blank 7.

In the first portion PA, the distance between the folding device 20 and the mandrel 10 is progressively reduced up to the abutment position R2 in which the folding device 20 abuts the blank 7. The abutment position R2 is provided downstream of the first abutment position R1. In the second portion of the folding stroke PB the folding device is at least partially overlapped on the mandrel 10.

In the first position P1, which is provided downstream of the first abutment position R1, the folding device 20 is spaced apart from the mandrel 10 and from the blank 7 and positioned at an advanced position with respect to the mandrel 10. In the second position P2 the folding device is overlapped on the mandrel 10.

By moving the folding device 20 along the folding stroke P in a direction concordant to the movement trajectory M and in a direction contrary to the movement trajectory M, it is possible to bring the folding device 20 to subsequently interact with each mandrel 10 of the plurality of mandrels 10.

In a version not shown, the second movement arm comprises two arm portions internally provided with a serration and mutually spaced apart so as to define a housing seat for a rotatable toothed wheel. The teeth of the toothed wheel are shaped to couple with the serration of the arm portions, so that, following the rotation of the toothed wheel, a displacement of the second movement arm and, therefore, of the second folding device are generated.

Figure 11:
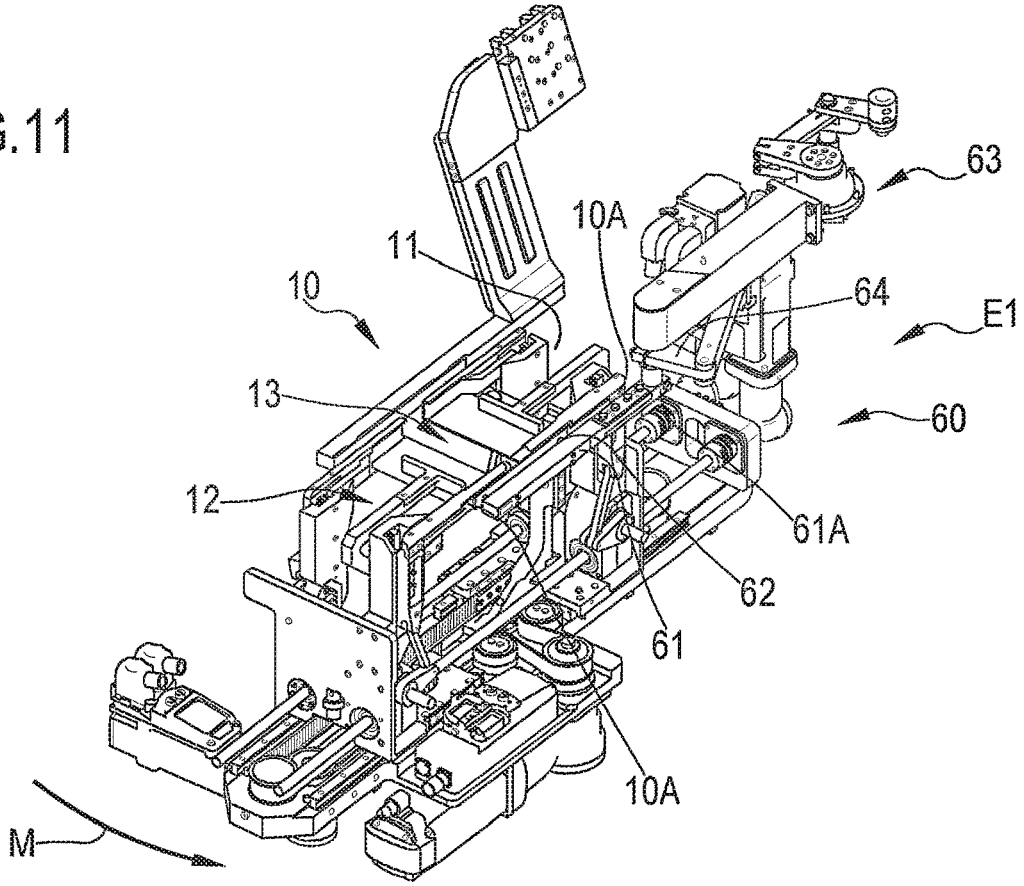
FIG. 11 is a schematic view of a portion of the packaging unit of FIG. 1.

The packaging unit 201 further comprises a retaining device 60, shown in greater detail in FIG. 11, displaceable along an actuation trajectory between an operating position E1 in which the retaining device 60 is approached to the first abutment surface 10A of the mandrel to retain the blank 7 against the first abutment surface 10A and a non-operating position not shown in the Figures in which the retaining device 60 is spaced apart from the first abutment surface 10A.

The retaining device 60 comprises a lamina 61 having a retaining surface 62 shaped so as to couple with shape coupling with the first abutment surface 10A.

The retaining device 60 is positioned so as to be interposed, in the operating position E1, between the first folding element 21 and the second folding element 22 to retain the intermediate panel 7C of the blank 7. The lamina 61 is configured to couple to the intermediate panel 7C.

The packaging unit 201 further comprises an actuation member 63 intended to move the retaining device 60 between the operating position E1 and the non-operating position.

The retaining device 60 is operatively associated with the mandrel 10 so as to be carried, via the movement device, together with the mandrel 10, along the movement trajectory M. The retaining device 60 is also movable with respect to the mandrel 10 in order to be displaced between the operating position E1 and the non-operating position.

Figure 12:
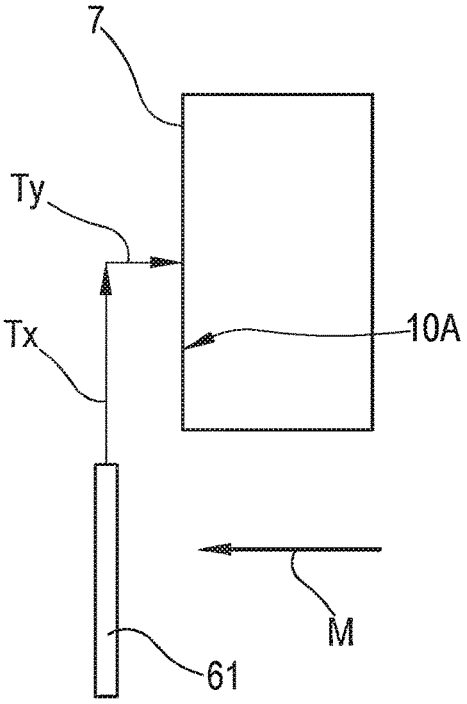
FIG. 12 is a schematic view showing the movement of a retaining element of the packaging unit of FIG. 1.

As best shown in FIG. 12, in the version shown, the lamina 61 is constrained at a first end 61*a* thereof to a support element 64 interposed between the lamina 61 and the actuation element 63 so as to be displaced between the operating position E1 and the non-operating position along an actuation trajectory having a transverse component Tx transverse to the movement trajectory M and a thrust component Ty parallel to the movement trajectory M. The transverse component Tx and the thrust component Ty are perpendicular to each other and parallel to the advancement plane 200.

The operation of the packaging unit 100 is now explained. An article 1 is deposited on a mandrel 10 at the receiving zone 202 and moved together with the mandrel 10 along the movement trajectory M. The mandrel 10 is moved along the movement trajectory M at a movement speed VM having modulus M2.

The feeding device 30 feeds a blank 7 towards the movement carousel 3, positioning it in a feeding position A1 provided along the movement trajectory M in an advanced position with respect to the mandrel 10 and moves the blank 7 along the movement trajectory M for a feeding stroke comprised between the feeding position A1 and a release position R3.

The mandrel 10 in movement along the trajectory M approaches the blank 7 until, in the first abutment position R1, the first abutment surface 10A of the mandrel 10 abuts the blank 7.

Subsequently, the mandrel 10 moves along the movement trajectory M together with the blank 7 and the feeding device 30 up to a release position R3 in which the feeding device 30 releases the blank 7. From the release position R3 the feeding device 30 is moved away from the movement trajectory M. From the release position R3 the mandrel 10 transports the blank 7 up to the abutment position R2 in which the folding device 20 abuts the blank 7. From the abutment position R2 to the second position P2 the mandrel 10 and the folding device 20 both move along the movement trajectory M folding the blank 7 around the mandrel. In the second position P2 the folding device 20 stops while the mandrel 10 continues its movement along the movement trajectory M coming out of the folding device 20 to enter the housing 18 defined between the first guide plate 16 and the second guide plate 17.

In the abutment position R2 the folding device 20 is moving along the folding stroke P at the accompanying speed Va which is parallel to the movement speed VM and has modulus M1 lower than the modulus M2 of the movement speed VM.

It is noted that when the folding device 20 abuts the blank 7, the folding device 20 is moved in a manner concordant to the mandrel 10 even if at a speed with a lower modulus and this prevents there being kickbacks on the blank 7 and sudden strokes being imparted on the same.

The folding device 20 abuts the blank 7 in the abutment position R2 and accompanies the mandrel up to the second position P2, that is up to the inlet of the housing 18.

Since the accompanying speed Va of the folding device 20 has a modulus M1 lower than the further modulus M2 of the movement speed VM, in the second portion PB of the folding stroke P a relative motion between the folding device 20 and the mandrel 10 and, therefore, between the folding device 20 and the blank 7 is generated since the latter is integral with the mandrel 10.

In other words, since in the second folding stroke PB the folding device 20 is slower than the mandrel 10 it progressively slides along the blank 7 in the direction opposed to the movement trajectory M, effectively folding the blank 7 around the mandrel 10.

Between the first abutment position R1 and the release position R3, on the movement trajectory M a retaining position R4 is defined in which the retaining device 60 is positioned in the operating position E1 and engages the intermediate panel 7C of the blank 7 to retain it on the mandrel 10.

The actuation member 63 is configured to displace the retaining device 60 towards the blank 7 so as to bring it against the intermediate panel 7C of the blank 7.

The presence of the retaining device 60 makes it possible to make the positioning of the blank on the mandrel 10 more precise so as to fold the blank around the mandrel in an extremely precise manner.

Between the abutment position R2 and the second position P2 a detachment position R5 can be provided in which the retaining device 60 moves away from the mandrel 10 and then from the blank 7 returning to the non-operating position. Since said detachment position R5 is provided downstream of the abutment position R2, when the retaining device 60 detaches itself from the blank 7, the latter is retained on the mandrel 10 in addition to the friction force generated by the movement of the mandrel 10 itself, also by the folding device 20 which has already engaged the blank 7 and which exerts a thrust force on the blank 7 to fold it on the mandrel 10. The blank 7 is therefore interposed between the mandrel 10 and the folding device 20. Thus, the blank 7 does not displace itself from the desired position.

Conveniently, by acting on the actuation element 63, it is possible to vary the duration of the retaining phase, i.e. the distance between the retention position R4 and the detachment position R5, based, for example, on the characteristics of the blank 7. In one embodiment, the retaining device 60 is held in the operating position E1 until the end of the forming step for forming the box 2.

In the version shown, the mandrel 10 and/or the folding device 20 are moved at respective speeds such as to define a relative speed comprised between about 0.1 and 1 m/s.

These values allow to effectively fold a blank around the mandrel avoiding damages to the blank and avoiding unwanted splashes of glue.

In the version shown, the release position R3 is provided upstream of the abutment position R2, however in other versions it may be provided downstream of the abutment position R2.

In other versions, moreover, the retaining device 60 may not be provided. This version of the packaging unit is particularly compact, moreover the absence of the retaining device and of the relative actuation members reduces the weight of the packaging unit simplifying its operation.

Figure 14A:
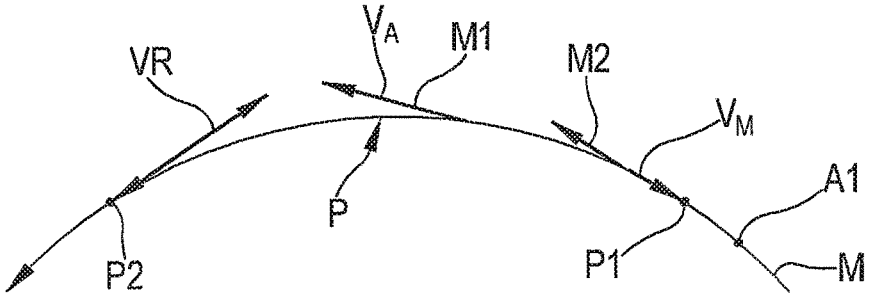
FIGS. 14A and 14B are two interrupted graphs of a movement trajectory of the packaging unit in the version of FIG. 13.
Figure 14B:
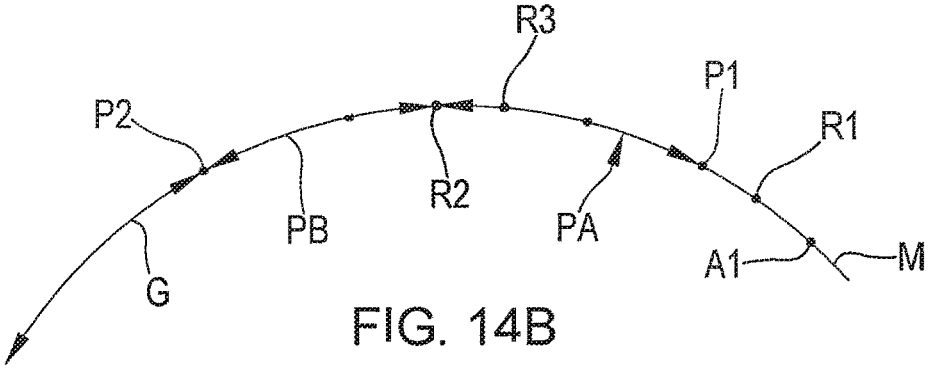
Figure 13:
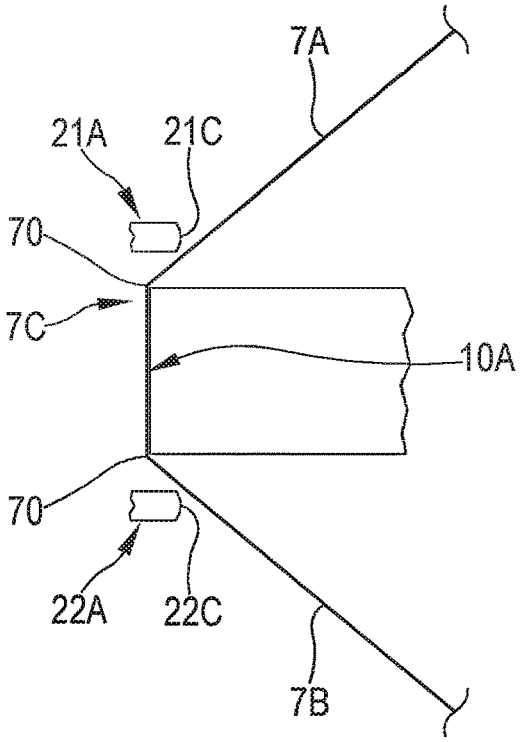
FIG. 13 is a schematic figure of a folding device and of a mandrel of a further version of the packaging unit of the invention and of a blank in a position of use.

An alternative version of the packaging unit is shown in FIGS. 13, 14A, 14B. This version of the transfer unit is completely similar to that described above, therefore, corresponding parts will be indicated with the same numerical references and will not be described in detail. Such a packaging unit differs from the one described above substantially in that it lacks the retaining device. This implies a different succession of the operations for transferring the blank 7, as better clarified below.

The operation of the aforesaid variant of the packaging unit 100 is now explained. An article 1 is deposited on a mandrel 10 at the receiving zone 202 and moved together with the mandrel 10 along the movement trajectory M. The mandrel 10 is moved along the movement trajectory M at a movement speed VM having modulus M2.

The feeding device 30 feeds a blank 7 towards the movement carousel 3, positioning it in a feeding position A1 provided along the movement trajectory M in an advanced position with respect to the mandrel 10 and moves the blank 7 for a feeding stroke of the movement trajectory M.

The mandrel 10 in movement along the trajectory M approaches the blank 7 until, in the first abutment position R1, the first abutment surface 10A of the mandrel 10 abuts the blank 7. Subsequently, the mandrel 10 moves along the feeding stroke together with the blank 7 and the feeding device 30 up to a release position R3 in which the feeding device 30 releases the blank 7. From the release position R3 the mandrel 10 transports the blank 7 up to the abutment position R2 where the folding device 20 abuts the blank 7. From the abutment position R2 to the second position P2 the mandrel 10 and the folding device 20 both move along the movement trajectory M folding the blank 7 around the mandrel 10. In the second position P2 the folding device 20 stops while the mandrel 10 continues its movement along the movement trajectory M coming out of the folding device 20 to enter the housing 18 defined between the first guide plate 16 and the second guide plate 17.

The blank 7 is abutted by the folding device 20 after having been released by the feeding device 30 in the release position R3. Between the release position R3 and the abutment position R2 the blank 7 is transported only by the mandrel 10. There are no further devices intended to keep the blank 7 on the mandrel 10. The blank 7 is kept on the mandrel 10 by the friction generated by the movement of the mandrel 10 along the movement trajectory M.

The number of components of the packaging unit 100 placed near the blank 7 is extremely small, therefore the packaging unit 100 is particularly compact and of reduced weight, therefore more easily actuatable. This also implies that the risk of interferences between the different components of the packaging unit 100 is extremely low.

In addition, the folding device can be freely moved towards the mandrel to abut the blank.

Furthermore, in the portion of movement trajectory between release position R3 and abutment position R2, the blank 7 is kept on the mandrel 10 by the friction generated by the movement of the mandrel 10 itself. Therefore, due to the high movement speeds of the mandrel 10, the risk of unwanted displacements of the blank 7 is reduced.

In the abutment position R2 the folding device 20 is moving along the folding stroke P at the accompanying speed Va which is parallel to the movement speed VM and has modulus M1 lower than the modulus M2 of the movement speed VM.

Therefore, when the folding device 20 abuts the blank 7, the folding device 20 is moved in a manner concordant to the mandrel 10 even if at a speed with a lower modulus and this prevents there being kickbacks on the blank 7 and sudden strokes being imparted on the same. This prevents unwanted displacements of the blank 7 from the desired position on the mandrel 10.

The actuation device 40 moves the first 21 and the second folding element 22 so that they abut the blank 7 almost simultaneously. In other words, both the first 7A and the second panel 7B are abutted in the abutment position R2. This avoids slippages of the blank 7 with respect to the desired position.

The first folding element 21 and the second folding element 22 are positioned symmetrically with respect to the advancement plane 200, so as to avoid unwanted displacements of the blank 7 from the desired position.

The folding device 20 abuts the blank 7 in the abutment position R2 and accompanies the mandrel up to the second position P2, that is up to the inlet of the housing 18.

Since the accompanying speed Va of the folding device 20 has a modulus M1 lower than the further modulus M2 of the movement speed VM, in the second portion PB of the folding stroke P a relative motion between the folding device 20 and the mandrel 10 and, therefore, between the folding device 20 and the blank 7 is generated since the latter is integral with the mandrel 10.

In other words, since in the second folding stroke PB the folding device 20 is slower than the mandrel 10 it progressively slides along the blank 7 in the direction opposed to the movement trajectory M, effectively folding the blank 7 around the mandrel 10.

In the version shown, the mandrel 10 and/or the folding device 20 are moved at respective speeds such as to define a relative speed comprised between about 0.1 and 1 m/s.

Such values allow to effectively fold a blank 7 around the mandrel 10 avoiding damages to the blank 7 and avoiding unwanted splashes of glue.

In an alternative version not shown, the folding device 20 abuts the blank 7 before the mandrel 10, that is, the abutment position R2 is provided upstream of the first abutment position R1. In this case the release position R3 is provided downstream of the abutment position R2 and upstream of the first abutment position R1, between the release position R3 and the abutment position R2 the blank 7 is retained only by the folding device 20 and kept thereon by effect of friction.

Therefore, a packaging unit is obtained that allows the blank to be folded precisely on a mandrel.

The invention claimed is:

1. A packaging unit for packaging articles in boxes, comprising:

a mandrel configured to accommodate at least one of said articles inside the mandrel and configured to have a blank wrapped around the mandrel, a forming carousel configured to move said mandrel along a movement trajectory at a movement velocity, the movement velocity having a movement magnitude and a movement direction, a feeding device configured to feed at least one blank towards said mandrel along a feeding trajectory which intersects said movement trajectory, a folding device configured to abut said blank and configured to fold said blank around an outside of said mandrel, when said blank is positioned between said mandrel and said folding device and when said at least one of said articles is contained inside said mandrel, to form one of said boxes, and an actuation device configured to displace said folding device along at least one folding stroke, the at least one folding stroke having an accompanying velocity, the accompanying velocity having at least one accompanying velocity component with a same direction as the movement direction, the accompanying velocity component having an accompanying velocity component magnitude, wherein the accompanying velocity component magnitude is lower than the movement magnitude.

2. The packaging unit according to claim 1, wherein said accompanying velocity is parallel to said movement velocity in said folding stroke.

3. The packaging unit according to claim 1, wherein said actuation device is configured to displace said folding device (a) along a first portion of said folding stroke in which said folding device is spaced apart from said blank, and (b) along a second portion of said folding stroke in which said folding device is in contact with said blank to fold said blank on said mandrel.

4. The packaging unit according to claim 1, wherein said folding device comprises a first folding element and a second folding element, the first folding element and the second folding element arranged to respectively abut a first panel and a second panel of said blank, said first panel and said second panel being provided on opposite sides of said blank with respect to an advancement plane defined by said mandrel when moved along said movement trajectory.

5. The packaging unit according to claim 4, at least one of said first folding element and second folding element comprising:

a folding portion shaped to interact with said blank, and a movement arm extending from said folding portion and coupled to said actuation device to actuate said at least one of said first folding element and second folding element.

6. The packaging unit according to claim 5, wherein said folding portion defines a first impact surface to interact with said blank, the first impact surface having a rounded shape.

7. The packaging unit according to claim 6, wherein the rounded shape of the first impact surface is convex toward said blank.

8. The packaging unit according to claim 4, the first folding element and the second folding element each comprising:

a respective folding portion shaped to interact with said blank, and a movement arm extending from said folding portion;

said actuation device comprising:

a first actuation element arranged to actuate said first folding element, and a second transmission element arranged to actuate said second folding element.

9. The packaging unit according to claim 1, wherein said actuation device is configured to actuate said folding device along said folding stroke between a first position and a second position at an accompanying velocity and to further actuate said folding device from said second position to said first position at a return velocity with approach to said mandrel, said return velocity having a return direction opposite to said movement direction.

10. The packaging unit according to claim 1, the packaging unit further comprising a retaining device displaceable between an operating position and a non- operating position, wherein, in the operating position, said retaining device approaches a first abutment surface to retain said blank against said first abutment surface, and wherein, in the non-operating position, said retaining device is spaced apart from said first abutment surface.

11. The packaging unit according to claim 10, the packaging unit further comprising an actuation member configured to displace said retaining device along an actuation trajectory to bring said retaining device towards said operating position.

12. The packaging unit for packaging articles in boxes according to claim 1, wherein said packaging unit further comprises a plurality of mandrels, wherein each mandrel is configured to accommodate at least one of said articles inside it, wherein said forming carousel is configured to move each mandrel along said movement trajectory, and wherein said folding device is configured to fold one of a plurality of blanks around one of the plurality of mandrels when said one of the plurality of blanks is positioned between said one of the plurality of mandrels and said folding device to form one of said boxes.

13. A method for packaging articles in boxes comprising:

providing a mandrel configured to accommodate at least one of said articles inside the mandrel and configured to have a blank wrapped around the mandrel, providing a folding device configured to fold a blank around an outside of said mandrel to form said box when said at least one of said articles is contained inside said mandrel, providing a feeding device configured to feed at least one blank towards said mandrel, depositing at least one of said articles in a mandrel, moving said mandrel along a movement trajectory at a movement velocity, the movement velocity having a movement magnitude and a movement direction, positioning a blank along said movement trajectory of said mandrel in an advanced position with respect to said mandrel so that said blank is interposed between said folding device and said mandrel, moving said folding device along at least one folding stroke of said movement trajectory with an accompanying velocity, the accompanying velocity having at least one accompanying component with a same direction as the movement direction, the accompanying component having an accompanying velocity component magnitude, wherein the accompanying velocity component magnitude is lower than the movement magnitude .

14. The method according to claim 13, the moving said folding device comprising the accompanying velocity that is parallel to said movement velocity in said folding stroke.

15. The method according to claim 13, wherein said folding device comprises a first folding element and a second folding element and wherein said moving said folding device comprises displacing said first folding element at the accompanying velocity and displacing said second folding element at the accompanying velocity.

16. The method according to claim 15, wherein said moving said folding device comprises displacing said first folding element and displacing said second folding element in a synchronised manner.

17. The method according to claim 13, wherein said folding device comprises a first folding element and a second folding element and wherein said moving said folding device comprises actuating said first folding element at a first accompanying velocity and further actuating said second folding element at a second accompanying velocity, said second accompanying velocity having the same direction as said first accompanying velocity and a second magnitude lower than a first magnitude of said first accompanying velocity.

* * * * *